US006092400A

United States Patent [19]

Sumner et al.

[11] Patent Number: 6,092,400

[45] Date of Patent: Jul. 25, 2000

[54] WASHING MACHINE

[75] Inventors: Barry David Sumner, Esher; Martin William Myerscough, London, both of United Kingdom

[73] Assignee: Monotub Industries plc, United Kingdom

[21] Appl. No.: 09/306,548

[22] Filed: May 6, 1999

Related U.S. Application Data

[63] Continuation of application No. PCT/GB97/03072, Nov. 7, 1997.

[30] Foreign Application Priority Data

Nov. 8, 1996 [GB] United Kingdom ..... 9623443
Jul. 1, 1997 [GB] United Kingdom ..... 9713935

[51] Int. Cl.[7] ..... D06F 21/10

[52] U.S. Cl. ..... 68/142; 68/210

[58] Field of Search ..... 68/58, 140, 142, 68/144, 210; 34/596, 599, 601, 602, 603; 210/380.2, 380.3; 134/119, 120; 366/232, 234

[56] References Cited

U.S. PATENT DOCUMENTS

| | | | |
|---|---|---|---|
| 801,627 | 10/1905 | Wunsch . | |
| 2,391,634 | 12/1945 | Lewis et al. . | |
| 2,538,200 | 1/1951 | Johnston . | |
| 2,539,533 | 1/1951 | Douglas . | |
| 2,561,186 | 7/1951 | Dunham . | |
| 2,615,320 | 10/1952 | Belaieff . | |
| 2,637,186 | 5/1953 | Douglas . | |
| 2,637,189 | 5/1953 | Douglas . | |
| 2,667,777 | 2/1954 | Kling et al. | 68/58 X |
| 2,784,500 | 3/1957 | Beaumont | 34/602 X |
| 2,817,501 | 12/1957 | Schubert | 366/234 X |
| 2,895,320 | 7/1959 | Long . | |
| 3,803,882 | 4/1974 | Brennan . | |
| 4,941,333 | 7/1990 | Blessing . | |

FOREIGN PATENT DOCUMENTS

| | | |
|---|---|---|
| 1075624 | 4/1954 | France . |
| 1472650 | 3/1966 | France . |
| 1 017 128 | 10/1957 | Germany . |
| 1017128 | 10/1957 | Germany . |
| 42 02 760 A1 | 8/1993 | Germany . |
| 119892 | 11/1958 | New Zealand . |
| 156403 | 8/1971 | New Zealand . |
| 782145 | 9/1957 | United Kingdom . |

*Primary Examiner*—Philip R. Coe
*Attorney, Agent, or Firm*—Fredrikson & Byron, PA

[57] ABSTRACT

A washing machine including a drum and a perforated container. The drum is rotatably mounted about an axis and includes a generally open front end. The perforated container is arranged to be positioned within the drum. The outer surface of the container is shaped and dimensioned to closely correspond to the inner surface of the drum when the container is positioned within the drum so the internal volume of the perforated container is only slightly smaller than that of the drum. The container is removable through the front opening of the drum. The washing machine also includes a removable closure adapted to at least partially close the front opening of the drum. If so desired, the removable closure may be an integral part of the perforated container.

14 Claims, 6 Drawing Sheets

WASHING MACHINE

RELATED APPLICATIONS

This is a continuation of International Application No. PCT/GB97/03072 filed Nov. 7, 1997, which claims priority to British application No. 9713935.6 filed Jul. 1, 1997 and British application No. 9623443.0 filed Nov. 8, 1996.

BACKGROUND OF THE INVENTION

Conventionally washing machines include a fixed water tank having a top or front opening. A rotatable drum is provided within the tank, the drum having perforated side walls to allow water from the water tank to enter the drum, and an opening which corresponds generally with the opening in the water tank. The opening of the drum has a diameter smaller than the inside of the drum giving an annular ring around the opening. A door providing a water tight seal closes the openings in the drum and water tank.

In use, a user opens the door, thereby giving access to the interior of the drum, and adds items to be washed through this opening into the drum. The door is then closed and the water tank is partially filled with water to commence the washing cycle. The drum is rotated, thereby moving the items in the drum through the water contained in the tank. Agitators are provided in the drum to enhance this movement. The annular ring around the opening in the drum prevents items from passing through the opening and into the water tank itself and prevents them becoming damaged by contact with a fixed door. After completion of the washing cycle, the water in the water tank is drained away and the drum is rotated at high speed to spin out any excess water. After this the door is opened and the user reaches into the interior of the drum and removes the items which have been washed individually.

To avoid the necessity of removing each washed item individually, attempts have previously been made to collect items together within the rotatable drum, either by using a plastics clip to physically attach items together, for example socks, or a bag made from netting which can be placed into the rotatable drum through the small opening to the drum and removed from the drum after completion of the washing cycle as a single item. Such arrangements have not achieved commercial success, provably because they do not allow a complete washload to be kept together due to their limited volume compared to that of the drum.

SUMMARY OF THE PRESENT INVENTION

According to the present invention, a washing machine comprises:

- a drum rotatably mounted about an axis, and including a generally open front end;
- a perforated container arranged to be positioned within the drum, the outer surface of the perforated container corresponding closely with the inner surface of the drum, the perforated container having an internal volume substantially equal to that of the drum, and being removable through the front opening of the drum; and,
- a removable means for at least partially closing the front opening of the drum.

With this arrangement, the items to be washed are provided within a perforated container having almost the same capacity as the drum. Therefore the capacity of the washing machine is not reduced significantly by the inclusion of the perforated container, and the movement of the items, which is necessary to ensure efficient washing, is not inhibited.

The perforations on the perforated container allow the free flow of water between the inside of the drum and the inside of the perforated container, and therefore ensures the items are soaked, washed and rinsed in exactly the same way as if the perforated container were not provided.

The removable means for partially closing the front end of the drum is arranged so that in use items to be washed which are contained in the perforated container cannot be dispelled through the front opening of the drum.

The axis around which the drum rotates may be a horizontal axis, although it is preferred that the axis is inclined to the horizontal. Where the drum is inclined, water within the drum will remain below the open end of the drum, and therefore there is no need to provide a water tight seal to contain the water.

As the perforated container is removable from the drum, the removable closure means may be an integral part of the perforated container. In this case, the closure means may be an end surface of the perforated container which coincides with the open front end of the drum, and in this case may be a surface which extends over substantially the entirety of the opening of the drum. Where the front end of the perforated container comprises a surface extending over the entire opening of the drum, a separate opening is provided in the perforated container to allow items to be added to and removed from the perforated container. This opening may be provided by a hinge extending along the edge of the perforated container parallel to the longitudinal axis of the perforated container. In this case the perforated container can easily be opened out once removed from the drum to allow easy access to the items in the perforated container. It is however preferred that the end surface of the perforated container includes an opening through which items to be washed can be added or removed from the perforated container, and in this case the end surface of the perforated container does not extend over the entirety of the opening of the drum, but gives only a partial closure. This allows items to be added to and removed from the perforated container when this is provided within the drum of the washing machine, and in particular allows items to be added and removed during the washing cycle. In this case it is preferred that the opening in the end of the perforated container is a generally central opening, thereby giving an annular cover which extends around the side of the opening in the front of the drum. This is advantageous as any items being washed which may approach the front end of the drum during washing will be close to the side of the drum due to the rotation of the drum.

Alternatively or additionally, the removable means may be in the form of a separate cover which is provided to close the end of the drum. This cover can be provided either on the drum itself, or on the perforated container, in which case the cover will rotate with the drum. The cover may be hinged to the drum or perforated container.

Although the drum is preferably generally cylindrical, the drum advantageously has a slightly larger diameter at its rear end than at its front opening end. With this arrangement, when the drum is rotated at high speed to spin water, the water will be forced towards the back of the drum where it may be collected easily. The drum may have solid side walls, or the side walls may be apertured so the drum has a frame like appearance.

Preferably the perforated container is of a resilient material so that the perforated container retains its shape. The perforated container is preferably generally cylindrical, but advantageously is slightly tapered with the closed rear end having a smaller diameter than the front end. This slightly frusto-conical shape facilitates easy positioning of the perforated container in and removal from the drum.

Advantageously, the perforated container includes projections projecting radially inwardly of the perforated container. In use these projections, or agitators, lifts the items in the perforated container as it is rotated. With this arrangement, the drum can have smooth side walls to allow easy insertion and removal of the perforated container, however the raised projections on the inside of the perforated container act to provide sufficient agitation to the clothes during the washing cycle to clean the clothes efficiently.

Where the perforated container is made from a resilient material, as the drum rotates, centrifugal force will cause the perforated container to flex outwardly into contact with the inside of the drum thereby holding the perforated container in place. Alternatively, the perforated container may be held in place by other fixing means, for example a bayonet fitting or snap fitting.

Water may be removed by centrifugal force during a spinning operation forcing the water to the outside of the drum where it is collected and removed, for example through an outlet point mounted on a fixed arm within the rotatable drum. Alternatively, holes may be provided on the back surface of the drum at a height below the front end of the drum so that water is discharged through the holes. Alternatively or additionally, collectors may be provided on the back of the drum which collect and lift water as the drum rotates to discharge the water through an outlet provided on the back of the drum.

DETAILED DESCRIPTION OF PREFERRED EXAMPLES

Figure 1:
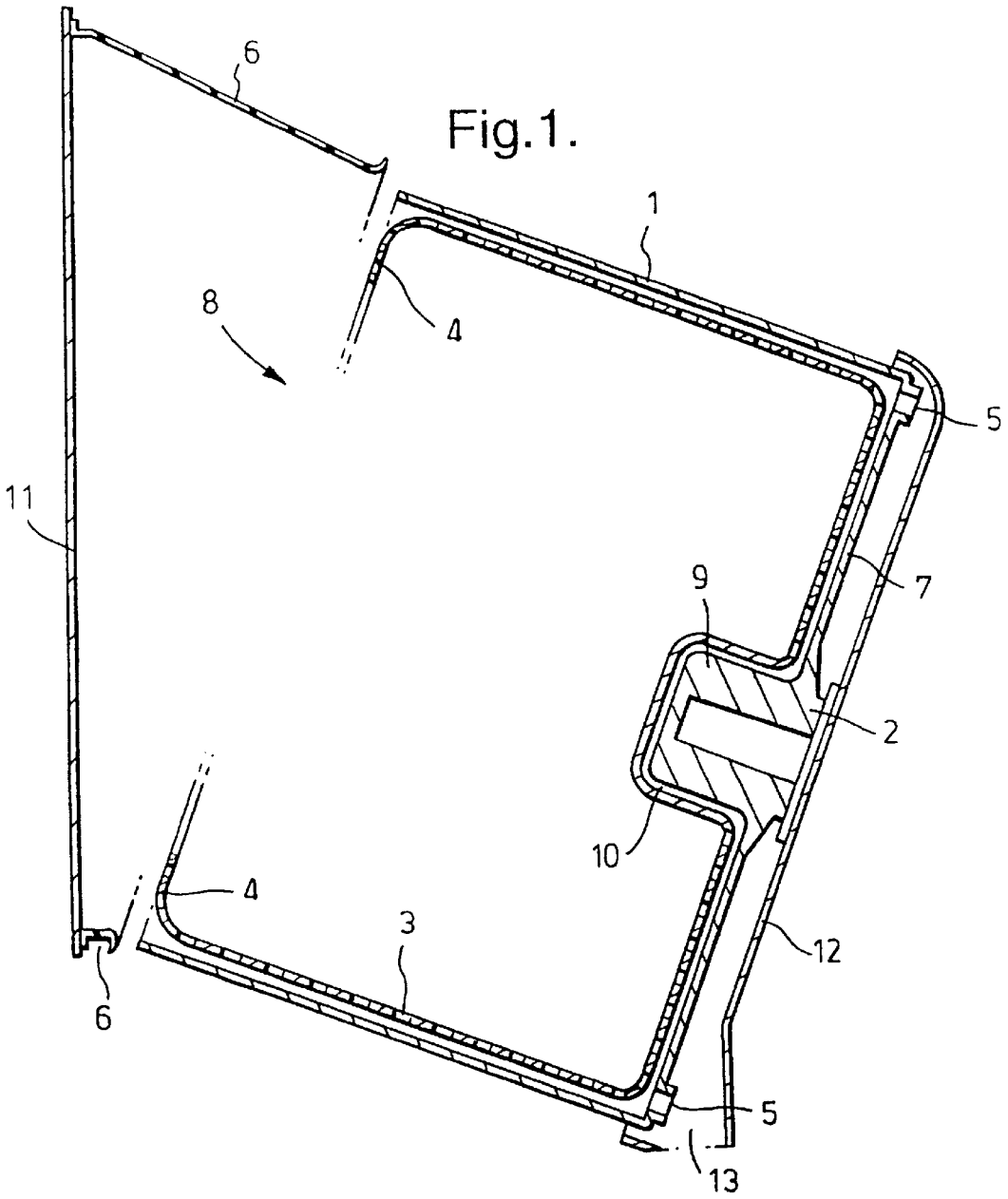
FIG. 1 shows a cross-section through an example of a washing machine including a perforated container.

FIG. 1 shows a cross-sectional view taken through the axis of a generally cylindrical drum of a washing machine according to the present invention. The cylindrical drum includes side walls 1 and a circular back end wall 7 defining a drum with an open front 8. The drum is mounted on an axial spindle 2 for rotation about its axis which is inclined to the horizontal at an angle of about 20°. The back surface 7 of the drum includes a plurality of outlet holes 5. The lowest outlet hole 5 is below the height of the lip of the open front 8.

The drum also includes a removable perforated container 3 which is positionable within the drum through the front opening 8 of the drum, and which is removable through the front opening 8. The perforated container 3 is shaped and dimensioned to closely correspond to the internal walls of the drum so the internal volume of the perforated container 3 is only slightly smaller than that of the drum. The perforated container 3 is generally tapered so that the front end including the opening has a larger diameter than the rear closed end. This assists in the insertion of the perforated container 3 into the drum. The perforated container 3 has perforations through which is water in the drum can pass into the perforated container 3, and through which water in the perforated container 3 can drain into the drum. The perforations are in the form of elongate slits having a width of about 2 mm and a spacing of about 2 cm. The perforated container 3 is held within the drum in such a way that the perforated container 3 rotates with the drum. This is achieved by a projection 9 provided on the drum which engages with a recess 10 on the perforated container 3. Where the projection 9 and recess 10 are provided axially, the projection 9 and recess 10 have a non-circular shape to transmit the rotation of the drum to the perforated container 3. The projection 9 and recess 10 may be provided non-axially, and in this case the projection 9 and recess 10 can have any desired shape. Alternatively, the projection may be provided on the perforated container 3 and the recess on the drum, or, where there is more than one projection and recess, a mixture of recesses and projections may be provided on both the drum and the perforated container 3.

The open end of the perforated container 3 includes an annular ring 4 giving a reduced diameter opening to the perforated container 3. The ring 4 ensures that clothes do ot fall out of the perforated container 3 during the ashing cycle.

Figure 2:
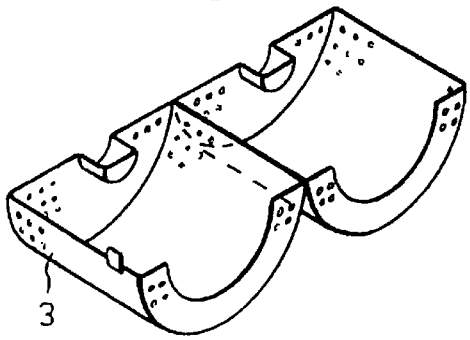
FIG. 2 shows an alternative perforated container.

As shown in FIG. 2, in one example the perforated container 3 includes a hinged portion extending along the side of the perforated container 3 generally parallel to the longitudinal axis of the perforated container 3. The perforated container 3 also includes a clasp to hold the perforated container 3 in its generally cylindrical shape. In this way, a clasp may be undone and the perforated container opened about the hinge to allow easy access to the contents of the perforated container.

Figure 3:
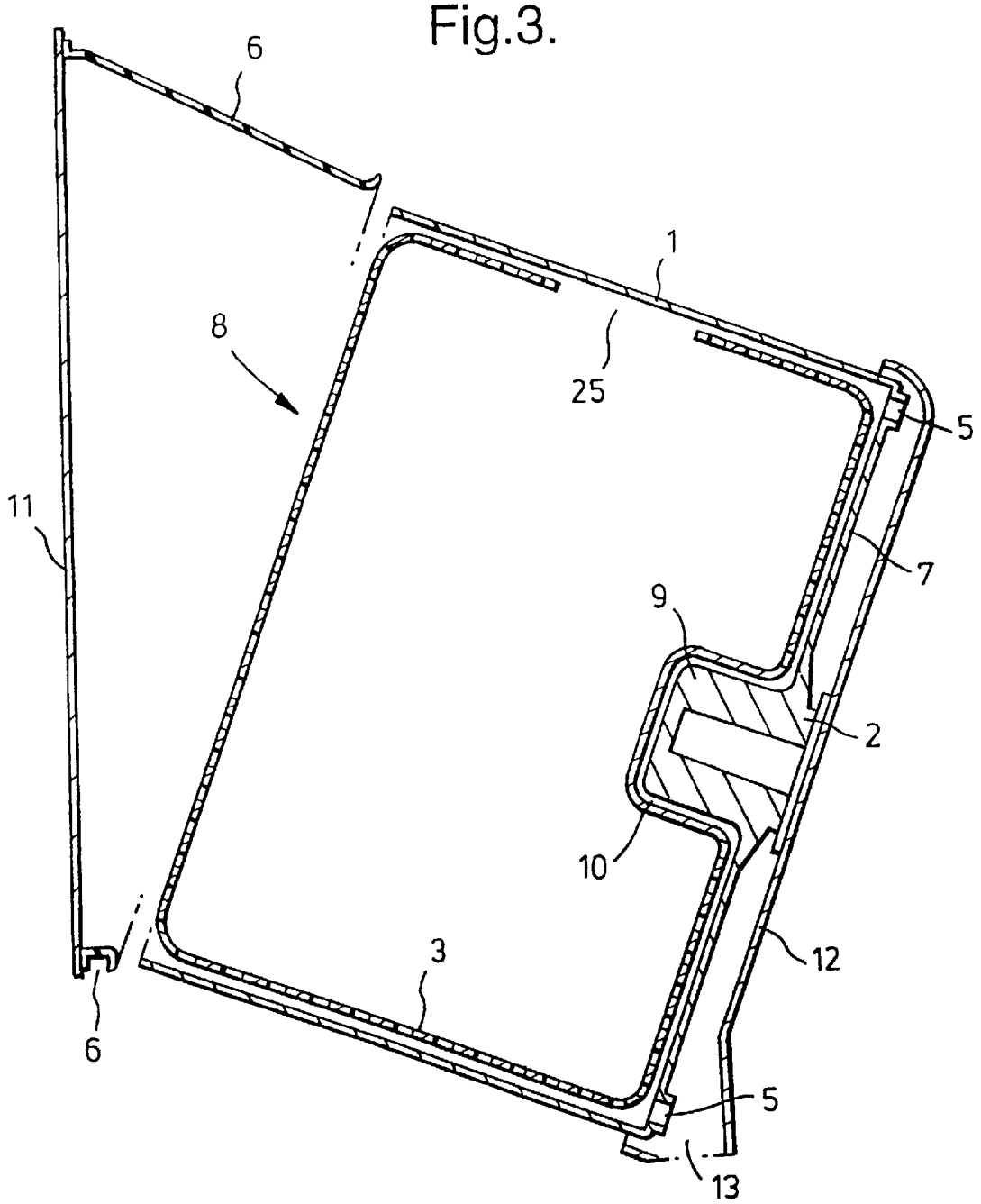
FIG. 3 shows an alternative perforated container provided in the machine of FIG. 1.

In an alternative example, as shown in FIG. 3, the perforated container includes a completely closed front end, and an opening 25 in the side wall. As the side wall corresponds closely with the inside of the drum, items contained within the perforated container are not able to fall from the perforated container through the opening into the drum. With this arrangement, items to be washed are added to the perforated container through the opening 25 before the perforated container is placed in the drum. When full, the perforated container is lifted into the drum, effectively closing the perforated container so all the items to be washed are maintained within the perforated container. With this arrangement, it is not possible to add items after the washing cycle has begun.

A shroud 6, inclined to the horizontal by the same angle as the drum is provided to a vertical front opening of the machine. The opening of the machine is closed by a door 11. This closure does not form a watertight seal but acts merely to prevent splashes during the washing cycle.

In use, clothes are placed into the perforated container 3, either before the filled perforated container 3 is put in the cylindrical drum through the front opening 8, or when the perforated container 3 has been positioned in the drum. Water, which may include washing detergent is introduced to the drum through the spindle 2. The water enters the perforated container 3 through the perforations in the perforated container to wet the clothes.

As the lowermost outlet 5 is below the height of the lip of the open front end 8, and due to the inclination of the drum, water entering the drum can rise to the level of the lowermost outlet 5, the lowest drainage point, and any additional water will drain through the lowermost outlet 5. As the lowest drainage point is below the level of the lip of the open front end 8, and providing the outlets 5 are of a suitable size the water level will not rise to that of the lip of the open front end 8.

As it is not necessary to close the front end 8 of the drum, it is possible to add garments after the wash cycle has begun.

When the water and clothes are in the perforated container 3 within the cylindrical drum, the drum is rotated about its inclined axis, thereby agitating the clothes in the water to wash them. Due to the inclination of the drum, water passes through the holes 5.

The rear 7 of the drum is positioned within a recess of a water collector 12. As water is discharged through the holes 5 in the back of the drum, this will be collected in the water collector 12, and will fall, under gravity, to the bottom of the water collector to be dispensed through the outlet 13. The rate at which the water is discharged from the drum is such that there is no need to provide a hermatic seal between the edge of the collector 12 and the outside of the drum.

During the washing cycle, the water may be recirculated, and may pass through a heater (not shown) to reheat the water, before being reintroduced to the drum through the inlet 2. This ensures that the water within the drum is maintained at the required temperature. When it is desired to dispense the water, the water from the outlet 13 is not recirculated, but is merely dispensed down a drain.

Figure 4:
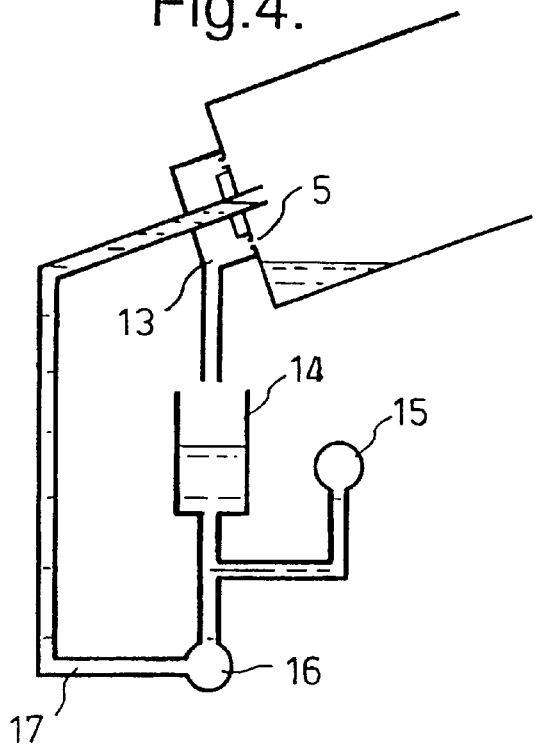
FIG. 4 shows a water volume determination system.

FIG. 4 shows a schematic view of a water volume detector which is provided in the recirculation path to determine the volume of the free water in the drum. In a conventional fixed-tank recycling washing machine, the volume of water in the tank can be determined by measuring the pressure difference in part of the recycling circuit. The water in the fixed tank is pumped from the tank, around a recycling path and back into the fixed tank. A pressure sensor provided between the tank and the pump detects the pressure due to the height of water in the tank, and from this the volume of water can be calculated from the measured pressure. The pressure in the drum is at atmospheric pressure as the drum is not perfectly sealed. Where the water tank is a rotating tank, this system cannot be used unless the outlet is provided at a fixed point below the surface of the water. As previously described this is difficult.

According to the present example, a system is provided to ensure that sufficient water is added to the drum to saturate the items to be washed completely. Water from an external source is added to a secondary chamber 14 which is open to the atmosphere. The water is pumped from the secondary chamber 14 into the main drum. Water discharged from the drum is introduced into the secondary chamber 14. A pressure detector 15 is provided between the secondary chamber 14 and the pump 16, and by measuring the pressure it is possible to determine the volume of water in the chamber 14. The secondary chamber 14 is open to the atmosphere, so the detected pressure is purely due to the head of water in the secondary chamber 14. If the secondary chamber 14 were closed, the pressure in the tank may vary as the volume of water compresses the air in the tank.

Initially, the water entering the secondary chamber 14 from the external source is pumped into the drum and is absorbed by items in the drum. No or little water will be discharged from the drum. When the items in the drum are completely saturated, additional water will be discharged from the drum into the secondary chamber 14. This additional water will change the rate of change of the volume of water in the secondary chamber 14, or the water in the secondary chamber will reach a predetermined volume. This is detected by the pressure sensor. When it is determined that sufficient water has been provided to the drum, the external supply can be cut off.

Figure 5:
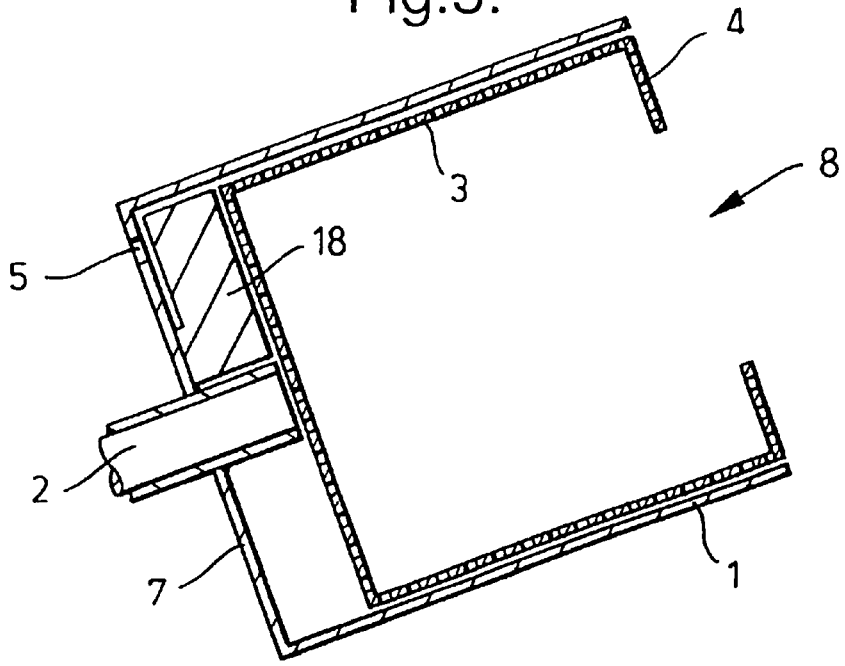
FIG. 5 shows a cross-sectional view through an alternative example of a washing machine drum.
Figure 6:
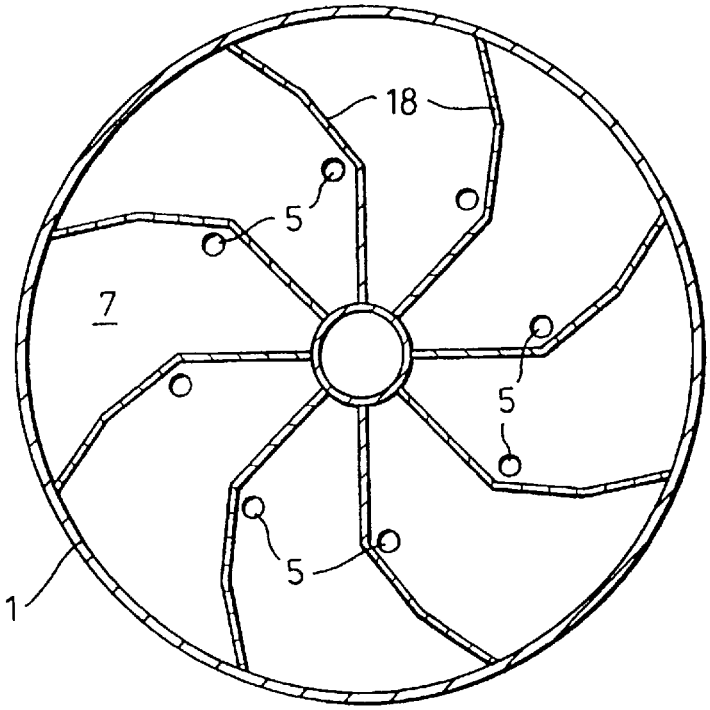
FIG. 6 shows an axial view of the washing machine drum of FIG. 5.

An alternative example of the present invention as shown in FIG. 5. In this case, collectors 18 are provided at the back of the drum. These collectors 18 are best seen in the axial view of FIG. 6, in which the perforated container has been removed for clarity. In this case, the collectors 46 are provided in the form of arms on the rear surface 7 of the drum. Due to the inclination of the drum, the water in the drum will fall, under gravity, to the back of the drum. Anti-clockwise rotation of the drum, when viewed from the front end 8 causes this water to be scooped up by the collectors 18. The continuing rotation of the drum causes the arms 18 to lift the water collected, and directs the collected lifted water through the outlet holes 5. Accordingly, by continually rotating the drum in an anti-clockwise direction, the water within the drum is expelled through the back 7 of the drum through the holes 5.

Where the drum rotates in a clockwise direction, the water will not be collected by the arms 46 due to their curved shape and therefore the water will remain within the drum.

Figure 7:
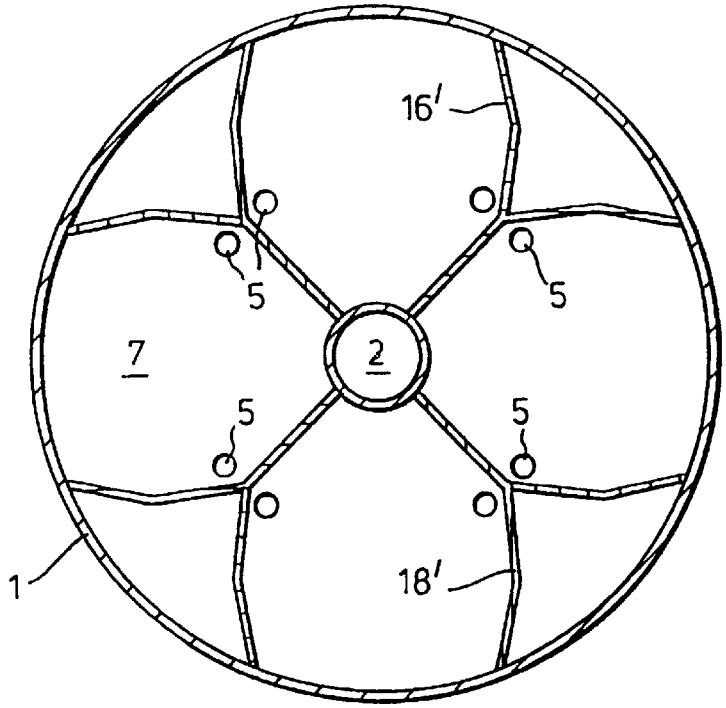
FIG. 7 shows an axial view of an alternative washing drum.

FIG. 7 shows a further alternative arrangement in which the arms 18' are shaped so that water is collect and expelled when the drum rotates in either direction.

Figure 8A:
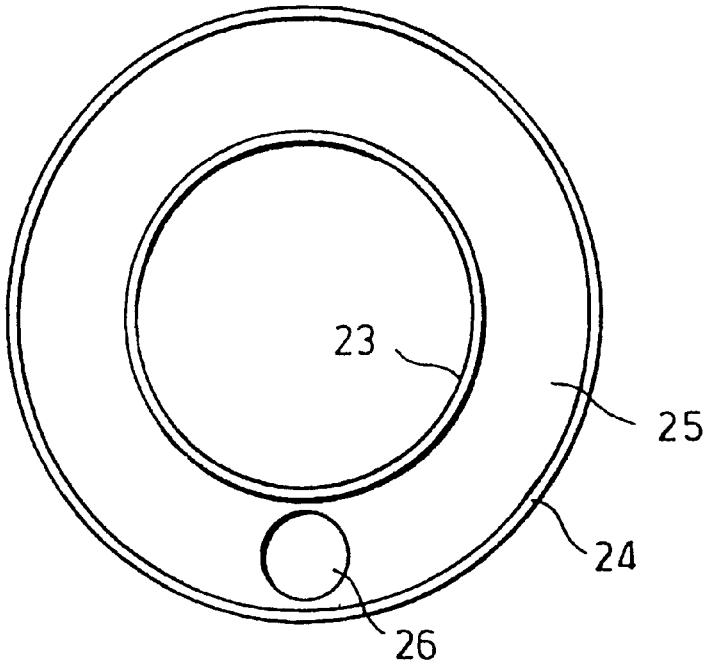
FIGS. 8*a* and 8*b* show an alternative water outlet arrangement.
Figure 8B:
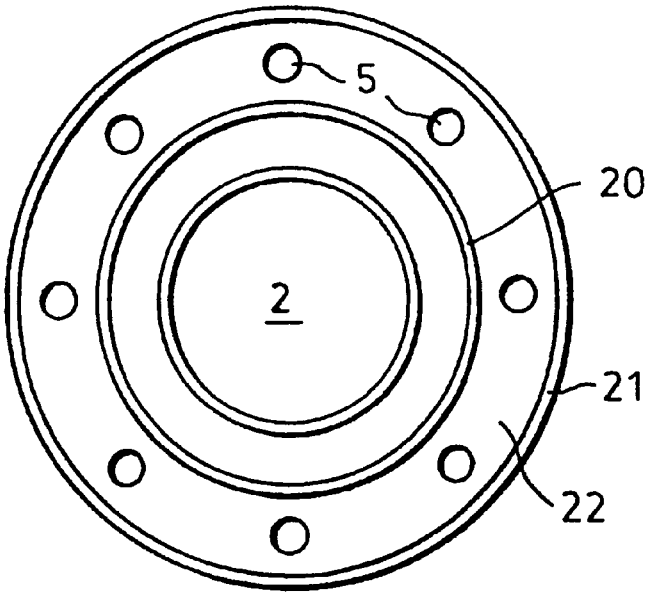

Rather than the recessed water collector 12, other systems can be provided to collect the water discharged through the rotating back end of the drum. As shown in FIG. 8*b,* the rear of the drum 7 may be provided with two annular rings 20 and 21 defining a channel 22 containing the outlet orifices 5. As shown in FIG. 8*a,* the housing of the washing machine similarly includes two annular walls 23, 24 to define a groove 25, the width of the groove 25 being such that the walls 20 and 21 on the back of the drum 7 may be provided within the groove 25. The groove 25 includes a single outlet 26, although additional outlets may be provided. With this arrangement, the drum is free to rotate, yet as water is dispensed through the dispensing orifices 5 it is constrained by the grooves 22 and 25 and directed to the single fixed outlet 26.

Figure 9:
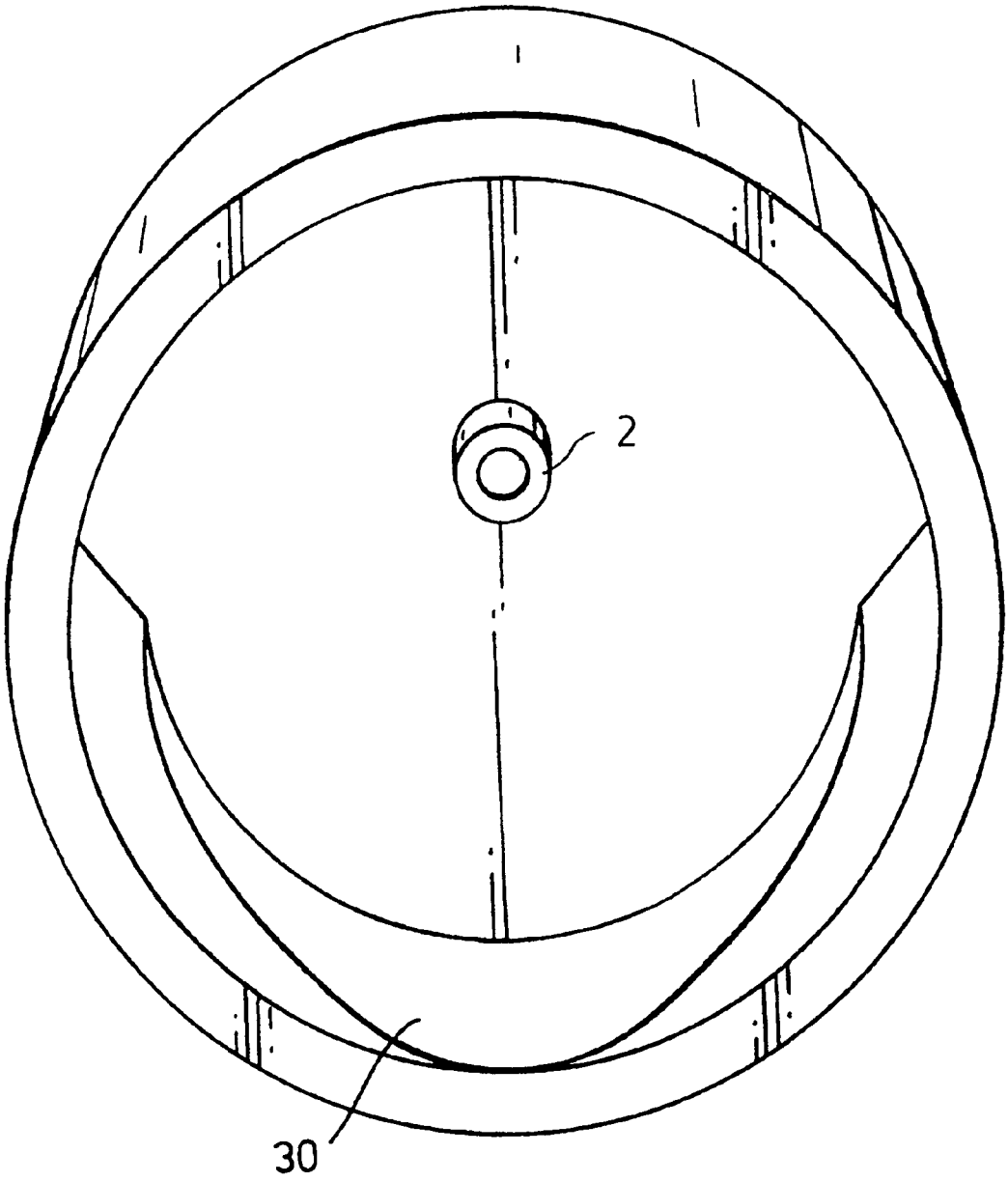
FIG. 9 shows agitators.

The drum or perforated container 3 may be provided with agitators to lift the clothes within the drum. As shown in FIG. 9 agitators are in the form of a projection 30 which extends from the back of the drum 7 circumferentially around the drum and towards the front of the drum and return to the back of the drum.

The base of the agitator 30 is generally triangular in cross-section, having a maximum height from the side walls 1 near the base 7 of the drum, and a minimum height near the front 8 of the drum. The cross-sectional shape of the agitator 30 may be other than triangular. The agitator 30 has rounded apexes to prevent damage to the clothes. Where the agitators are provided on the inside of the drum, the perforated container 3 is provided with corresponding agitators. In this case the agitators act to hold the perforated container within the drum to prevent relative rotational movement of the drum and perforated container 3 during the washing cycle. Although only one agitator 30 is shown, two or more agitators may be included.

Because the agitator 30 includes components extending towards the front of the drum in both a clockwise and anti-clockwise circumferential direction, on rotation of the drum, articles within the drum are lifted and drawn towards the front of the drum upon rotation of the drum in either direction.

What is claimed is:

1. A washing machine comprising:

a. a drum rotatably mounted about an axis and including a generally open front end;

b. a perforated container arranged to be positioned within the drum, the outer surface of the perforated container being shaped and dimensioned to closely correspond to the inner surface of the drum when the perforated container is positioned within the drum so the internal volume of the perforated container is only slightly smaller than that of the drum, and being removable through the front opening of the drum;

c. a removable closure adapted to at least partially close the front opening of the drum.

2. A washing machine according to claim 1, in which the axis around which the drum rotates in inclined to horizontal.

3. A washing machine according to claim 1, in which the removable closure is an integral part of the perforated container, the closure thereby being removable from the drum with the perforated container.

4. A washing machine according to claim 3, in which the removable closure is a surface of the perforated container which extends over substantially the entirety of the opening of the drum.

5. A washing machine according to claim 1, in which the perforated container includes a hinge extending along the edge of the perforated container to allow the perforated container to be opened once removed from the drum.

6. A washing machine according to claim 1, in which an end surface of the perforated container includes an opening through which items to be washed can be added to or removed from the perforated container.

7. A washing machine according to claim 6, in which the opening in the end of the perforated container is a generally central opening.

8. A washing machine according to claim 1, in which the removable closure comprises a separate cover which closes the opening of the drum.

9. A washing machine according to claim 1, in which the perforated container is made of a resilient material so that the perforated container retains its shape.

10. A washing machine according to claim 1, in which the perforated container has a front end and a closed rear end, the container tapering slightly such that the rear end has a smaller diameter than the front end.

11. A washing machine according to claim 1, in which the perforated container includes projections projecting radially inwardly of the perforated container which, in use, lift the items contained in the perforated container when the perforated container is rotated.

12. A washing machine according to claim 1, in which the perforated container is held in place by a projection provided on one of the perforated container and the drum, and a corresponding recess provided on the other of the perforated container and the drum.

13. A washing machine comprising:

a. a drum including a generally open front end and rotatably mounted about an axis inclined to horizontal;

b. a perforated container within the drum, the perforated container having an end surface including an opening through which items to be washed can be added to or removed from the perforated container and an outer surface corresponding closely with the inner surface of the drum, the perforated container having an internal volume substantially equal to that of the drum, and being removable through the front opening of the drum; and c. a removable closure adapted to at least partially close the front opening of the drum.

14. A washing machine comprising:

a. a drum rotatable about an axis and including a generally open front end;

b. a perforated container removably received within the drum with an outer surface of the perforated container positioned in close proximity to the inner surface of the drum so that the internal volume of the perforated container is only slightly smaller than that of the drum, the perforated container being removable through the front opening of the drum; and c. a removable closure adapted to at least partially close the front opening of the drum.

* * * * *